United States Patent [19]

Wilson

[11] 4,356,857

[45] Nov. 2, 1982

[54] LOUVERED PANEL ASSEMBLY WITH CHAIN TYPE LADDER TAPES

[75] Inventor: Thomas T. Wilson, San Carlos, Calif.

[73] Assignee: Epoxon Products, Inc., San Carlos, Calif.

[21] Appl. No.: 207,187

[22] Filed: Nov. 14, 1980

[51] Int. Cl.[3] ..... E06B 3/12

[52] U.S. Cl. ..... 160/229 B

[58] Field of Search ..... 160/107, 176, 178 E, 160/184, 229 B, 231 A, 231 R; 24/201 MM, 370, 372; 52/240, 342, 343, 473, 669

[56] References Cited

U.S. PATENT DOCUMENTS

| | | | |
|---|---|---|---|
| 2,133,113 | 10/1938 | Pratt | 52/473 |
| 2,228,621 | 1/1941 | Zwart | 160/231 R |
| 2,677,158 | 5/1954 | Mayer | 160/184 |
| 2,871,935 | 2/1959 | Jenkins et al. | 160/231 R |
| 3,074,127 | 1/1963 | Ellis | 160/176 |
| 3,389,737 | 6/1968 | Arnold et al. | 160/176 |

FOREIGN PATENT DOCUMENTS

| | | | |
|---|---|---|---|
| 1340929 | 9/1963 | France | 160/229 B |

*Primary Examiner*—Peter M. Caun

*Attorney, Agent, or Firm*—Eugene D. Farley

[57] ABSTRACT

A louvered panel assembly comprises a plurality of tape-supported louvers. Each tape comprises a plurality of inter-connected links. Each link supports a louver and comprises a substantially vertical link segment and an outwardly and downwardly angled louver-support segment. The angle of inclination of the louver-support segment relative to the link segment determines the angle of inclination of the louver supported by the link.

10 Claims, 5 Drawing Figures

LOUVERED PANEL ASSEMBLY WITH CHAIN TYPE LADDER TAPES

BACKGROUND AND GENERAL STATEMENT OF THE INVENTION

This invention relates to louvered panel assemblies (venetian blinds). It pertains particularly to fixed angle louvered panel assemblies of the class wherein the component louvers are supported by chain-type ladder tapes.

Louvered panels having component louvers of adjustable angle and having the capability of collapsing to vary the size of the openings with which they are associated are well known and of wide application. To enable performance of their characteristic functions, such panels are provided with louvers supported by fabric ladder tapes and operated by means of cords.

However, a need exists for louvered panels characterized by louvers of fixed angle and fixed vertical position. Such panel assemblies are useful, for example, where it is desirable to install fixed window blinds of predetermined size and outline, or where the panels form permanent parts of the decoration of the room in which they are situated.

Such panels are of particular importance in the construction and operation of the combination heat transfer panels and wall shields described and claimed in my co-pending application Ser. No. 9222, Filed Feb. 2, 1979. These products are designed for use between stove-type radiant heaters and combustible wall surfaces. They serve the important functions of preventing combustion of the wall, of directing the air flow in such a manner as to improve the efficiency of the heater, and of providing a pleasing ornamental surface in the area behind the heater.

The combination heat transfer panels and wall shields broadly comprise a case containing front and rear curtains spanning the sides of the case and forming a pair of vertical convection chambers which establish a desirable flow of heated air in the space being served by the heater.

For proper direction of the air flow, as well as for providing a desirable front appearance of the unit, it is desirable that the front curtain comprise a louvered panel assembly. However, to be suitable for this purpose, the louvered panel assembly must meet the following requirements:

Its components must be non-combustible.

The individual louvers or slats must be supported permanently in the desired angle of inclination required to secure proper air flow.

The individual louvers must be easily inserted and easily removed for purposes of cleaning, exchange of louvers, and access to areas behind the louvers.

The louvers must be held securely.

The louvers must be supported in conditions harmful to conventional textile venetian blind ladder tapes (e.g. cotton or polyester tapes) such as excessive heat, ultraviolet light and corrosive environments.

The assembly must be easily composited from a minimum number of preferably interchangeable parts.

The finished assembly should be available in a variety of commerical lengths and widths without serious modification of the manufacturing procedure.

It is the general purpose of the present invention to provide a louvered panel assembly characterized by the foregoing features and advantages.

Generally stated, these and other objects of the invention are achieved by the provision of a louvered panel assembly comprising a plurality of horizontally arranged, vertically spaced louvers supported by a plurality of substantially vertically arranged, horizontally spaced louver-supporting tapes.

Each tape comprises a plurality of links connected to each other. The links may be made of metal or other non-combustible material. Each link supports a louver and comprises a substantially vertical link segment, and an outwardly and downwardly angled louver-support segment arranged at a predetermined angle of inclination to the link segment. Each link segment has at its terminal portions upper and lower connecting means for releasable connection to the adjacent links. The louver associated with each link is dimensioned for insertion in the space between the support and link segments so that it is maintained demountably in place at an angle determined by the angle of inclination of the support segment relative to the link segment.

DESCRIPTION OF PREFERRED EMBODIMENTS OF THE INVENTION

Figure 1:
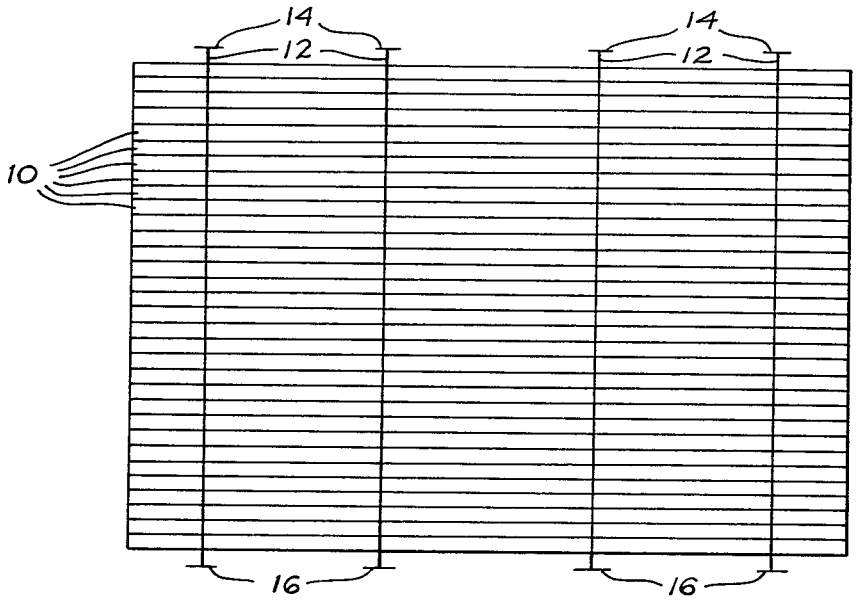
FIG. 1 is a schematic front elevation of a louvered panel assembly (venetian blind) of the class described herein.

FIG. 1 illustrates schematically a typical louvered panel of the invention. The panel comprises a plurality of louvers or slats 10 arranged horizontally in parallel relationship and supported by a plurality of vertically arranged, horizontally spaced, flexible tapes 12. The upper ends of the tapes are connected to upper support members 14. The lower ends of the tapes are connected to anchoring members 16.

Louvers 10 are constructed in the usual manner for venetian blinds, being elongated and slightly arcuate in contour. Where the panel is to be employed in the combination heat transfer panel and wall shield referred to above, the louvers preferably are made of metal or other non-combustible material.

Tapes 12 comprise a plurality of links connected to each other in the manner described in detail hereinbelow. Their upper ends are attached to suitable support members which may comprise hangers, rods, bars, or channel-shaped structural members.

Their lower ends preferably are attached resiliently to suitable anchoring members which likewise may comprise stationary supports such as hangers, bars, rods, or channel-shaped structural members.

Like the louvers, tapes 12 and the members by which they are supported preferably are made of metal or other non-combustible material.

As noted, each tape comprises a plurality of links flexibly and releasably connected to each other to form a chain type, louver-supporting ladder of the desired height. The construction and manner of operation of the tape is illustrated in detail in FIGS. 2, 3 and 4.

Each link is indicated generally at 18. It comprises a link segment 20 and a louver-supporting segment 22. These two components of the link preferably are formed by reversely bending or shaping a link of wire or other stiff flexible material. Alternatively they may be formed by molding or other suitable techniques.

As thus formed, each link includes an interior pocket 24 at the junction between the link and louver-support segments. Louver support segment 22 thus in effect forms a hook-like extension of link segment 20.

Means are provided at the outer terminal portion of louver-support segment 22 for supporting one of louvers 10.

To this end, the lower terminal portion of the louver support segment is reversely bent or shaped to form a seat 26 which receives the lower margin of louver 10 and gravitationally supports the louver.

Upper and lower connecting means are provided for interconnecting the link segments 20 of links 18 to form a chain of the desired length.

Although various types of connections may be used for this purpose, such as swivel pin connections and the like, it is preferred to employ a simple hook and eye connection which enables ready assembly and disassembly of the chain tape.

To this end the lower terminal portion of each link segment 20 is provided with a loop or eye 28. This preferably is formed integrally with the link segment, as by bending the lower terminal portion of the same. The diameter of its opening is substantially larger than the diameter of the wire or other structural material of which the link is constructed.

The reversely bent central section of the link including pocket 24 provides the cooperating component of the hook and eye connecting assembly.

Figure 4:
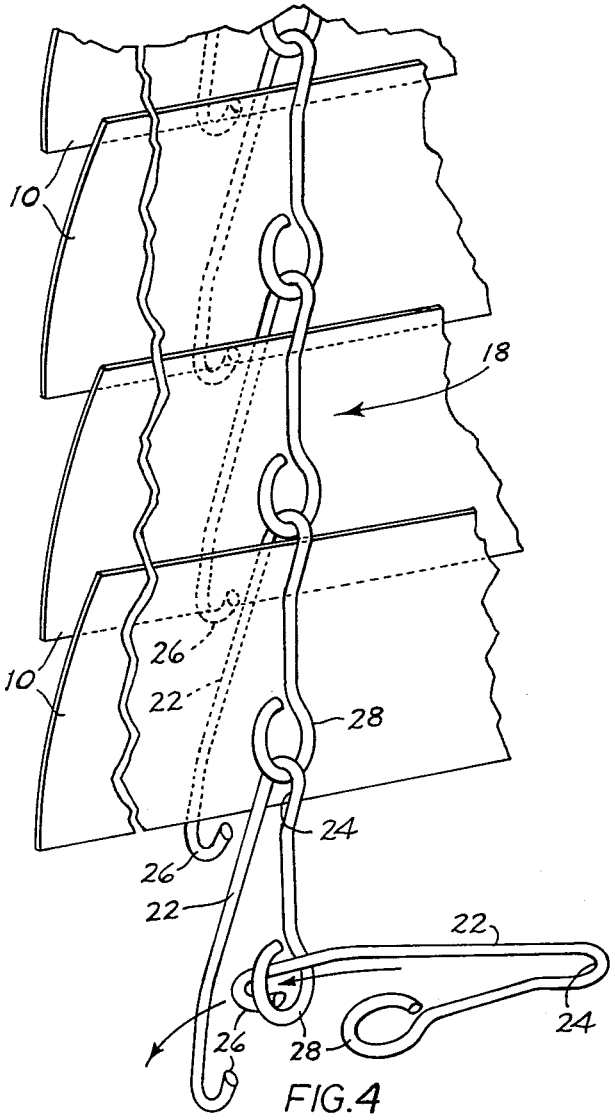
FIG. 4 is an enlarged, foreshortened, fragmentary view in back perspective of the louvered panel assembly of FIG. 2, illustrating its manner of assembly.

As shown in FIG. 4, connection is made by inserting the outer end of louver support segment 22 of one link through the eye 28 of the link immediately above. The relative positions of the two links then is adjusted until the eye 28 of one link seats in pocket 24 of the companion link. This can be accomplished by a simple movement of insertion. If it is desired to disassemble the chain, the links may be separated by a reverse movement of removal.

When the chain is in operative position, louver support arms 22 extend outwardly and downwardly at an angle relative to link segment 20 determined by the degree of reverse bending or shaping of the material of which the link is made. This angle normally is fixed so that the louvers supported by the links remain in a position of maximum operating efficiency throughout the entire service life of the panel.

Figure 3:
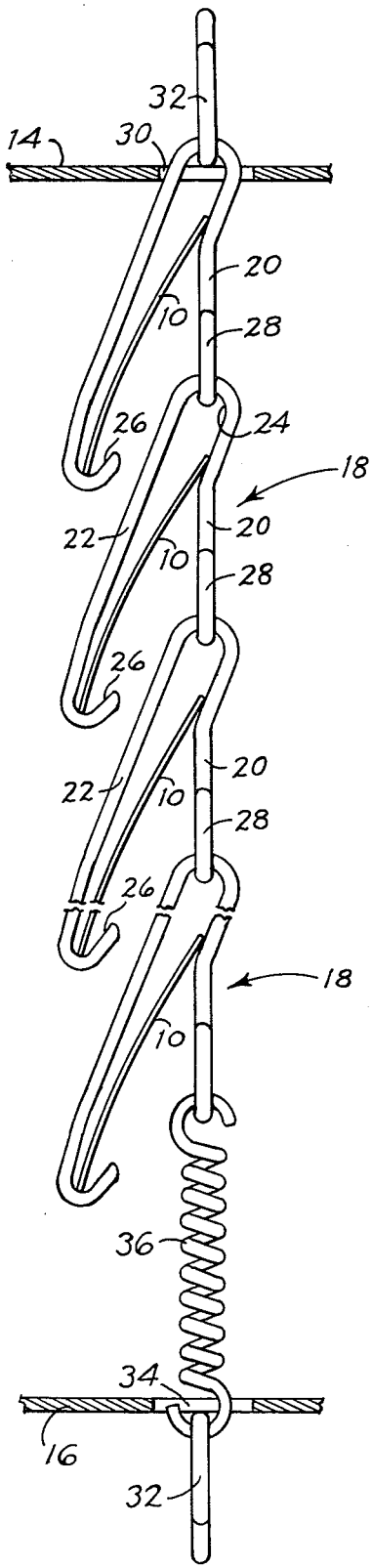
FIG. 3 is an enlarged, foreshortened, fragmentary view in end elevation of the louvered panel assembly of FIG. 2, looking in the direction of the arrows of line 3—3 of that figure.

As shown particularly in FIGS. 3 and 4, each louver is accommodated in the space between the outwardly and downwardly extending louver-support segment 22 and link segment 20. The lower end of the louver seats in the seat 26. The upper end of the louver bears against the sloping inner surface of pocket 24. The position of the louver thus is essentially fixed during its service life.

Each louver may be mounted easily by inserting it into the space between the component segments of the link, elevating it to the maximum height possible, and then dropping it downwardly until its lower margin seats in seat 26. Release of the louver then will cause it to bear gently against the upper portion of the link segment. When it is desired to remove the louver for such purposes as cleaning, repair and changing, this may be done by reversing the foregoing sequence.

Suitable support means are provided for supporting the upper ends of tapes 12 and accordingly hanging the entire panel assembly from the support.

Figure 2:
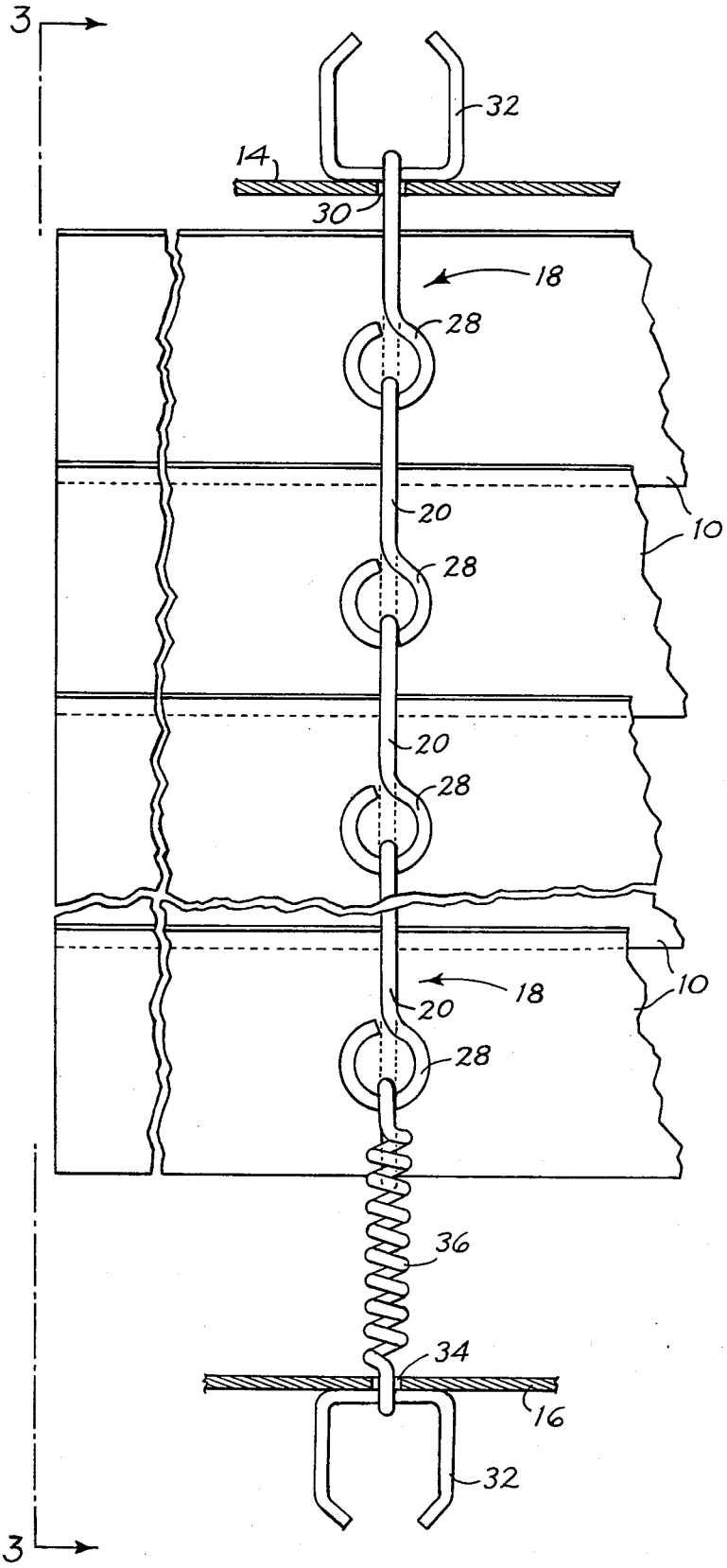
FIG. 2 is an enlarged, foreshortened, fragmentary view in back elevation of the hereindescribed louvered panel assembly in a first embodiment.

As shown in FIGS. 2 and 3, this is accomplished by providing a support such as a bar or a channel provided with a plurality of slots or openings 30, one for each tape. The slots are dimensioned to receive the reversely bent portion of the uppermost link of the tape. A keeper 32 then is inserted crosswise through pocket 24 to prevent withdrawal of the tape from the slot. Keeper 32 may comprise a simple pin, but for purposes of security, preferably is provided in the configuration of a U-shaped yoke, as illustrated.

Similarly, means are provided for anchoring the lower ends of the tapes to secure the panel in place.

Again a suitable structural member 16 is provided with slots 34. Also provided are resilient connectors which in the illustrated form of the invention comprise coil springs 36. The upper end of each coil spring hooks into the eye 28 of the lowermost link. The lower end of the coil spring extends through slot 34 and is pinned by a suitable keeper such as yoke 38.

Figure 5:
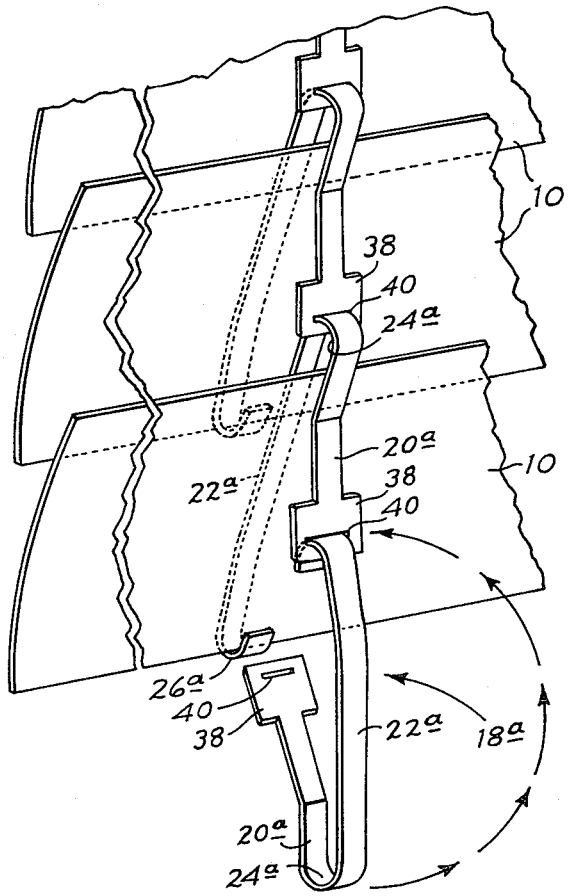
FIG. 5 is an enlarged, foreshortened, fragmentary back perspective view of the louvered panel assembly of the invention in an alternate embodiment.

An alternate construction is illustrated in FIG. 5. In this form of the invention, the links are made of flat bar stock rather than from round wire or rods.

Each link as indicated generally at **18*a* comprises a link segment 20*a* formed integrally with an outwardly and downwardly extending louver-support segment 22*a*. A pocket 24*a* is formed by the hook-like extension of louver-support segment 22*a***.

The lower portion of the latter segment is reversely and inwardly bent or shaped to form a seat **26*a***.

Link segment **20*a* has at its terminal portion a plate 38 having a transverse slit 40. This is dimensioned to receive the body of the link, which may be threaded into the slit in the manner illustrated in FIG. 5**.

When the links are coupled together and in their working positions, the lower margins of louvers **22*a* can be seated in seats 26*a* and the upper margins of the louvers may be rested in bearing position against the upper portions of link segments 20*a*** in the manner described above.

There thus is provided a louvered panel assembly having louvers fixed at a predetermined angle. The assembly comprises essentially a plurality of identical louvers supported by chain type ladder tapes made up of a plurality of identical links threaded together. The assembly may be rapidly composited. In use it is fixed and stable. When it becomes necessary and desirable, it may be easily and quickly disassembled into its component parts for storage or future use.

Having thus described my invention, I claim:

1. A louvered panel assembly comprising:

(a) a plurality of horizontally arranged, vertically spaced louvers, and (b) a plurality of substantially vertically arranged horizontally spaced, louver-supporting tapes, (c) each tape comprising a plurality of links connected to each other, (d) each link supporting a louver and comprising a substantially vertical link segment and an outwardly and downwardly angled louver-support segment extending from the upper end of the link segment, the louver-support segment having an inwardly reversely shaped lower end portion forming a seat supporting the lower margin of the louver and positioning the louver between the louver-support segment and the link segment, the upper margin of the louver bearing against the upper inside portion of the link segment, (e) the link segment having on its upper and lower terminal portions upper and lower connecting means, respectively, for connecting it to the adjacent links.

2. The louvered panel assembly of claim 1 wherein the link and louver-support segments of each link are disposed at an angle relative to each other predetermined to impart a desired degree of inclination to the louver supported thereby.

3. The louvered panel assembly of claim 1 wherein each link is formed from a piece of stiff structural material reversely shaped at its central portion to form an internal pocket for receiving the upper margin of the louver, the vertical depth of the pocket being sufficient to allow elevation of the louver to clear its lower margin from the seat.

4. The louvered panel assembly of claim 1 wherein each link comprises a piece of stiff structural material reversely shaped at its central portion to form a pocket which serves as the connecting means at the upper terminal portion of the link.

5. The louvered panel assembly of claim 1 wherein each link comprises a length of stiff structural material having at the lower terminal portion of the link segment an integrally formed eye comprising the lower connecting means.

6. The louvered panel assembly of claim 1 wherein the link connecting means comprises hook and eye connecting means.

7. The louvered panel assembly of claim 1 wherein each link comprises a length of stiff structural material reversely bent at its central portion to form an internal pocket between a link segment and a louver-support segment, the lower terminal portion of the louver-support segment being reversely shaped inwardly to form a louver-supporting seat, the lower terminal portion of the link segment being formed with an integral eye engageable with the pocket of the adjacent link, thereby interconnecting the two links.

8. The louvered panel assembly of claim 1 wherein each link comprises an elongated flat strip of stiff structural material reversely shaped at its central portion to form a link segment and an outwardly angled louver-support segment, the terminal portion of the louver-support segment being inwardly reversely shaped to provide a seat for the lower margin of the associated louver, the reversely shaped central portion forming a pocket, the link segment at its lower terminal portion having a slot dimensioned to receive the end of the louver-support segment of the next lower link for threading the same through the slot to a position in which the lower terminal portion of the first named link is seated in the pocket of the next lower link thereby supporting the same.

9. A louvered panel assembly comprising:

(a) a plurality of horizontally arranged, vertically spaced louvers, (b) a plurality of substantially vertically arranged horizontally spaced, louver-supporting tapes, (c) each tape comprising a plurality of links connected to each other, (d) each link supporting a louver and comprising a substantially vertical link segment and an outwardly and downwardly angled louver-support segment, (e) the link segment having on its upper and lower terminal portions upper and lower connecting means, respectively, for connecting it to the adjacent links, (f) an upper support member comprising a slotted structural element, the slots being dimensioned to receive the upper terminal portions of the uppermost links of the tapes, and (g) connecting means for connecting the tapes to the upper support member, the connecting means comprising pin means dimensioned for insertion in the pockets of the upper terminal portions of the uppermost links for releasably interengaging them with the upper support member.

10. A louvered panel assembly comprising:

(a) a plurality of horizontally arranged, vertically spaced louvers, (b) a plurality of substantially vertically arranged horizontally spaced, louver-supporting tapes, (c) each tape comprising a plurality of links connected to each other, (d) each link supporting a louver and comprising a substantially vertical link segment and a outwardly and downwardly angled louver-support segment, (e) the link segment having on its upper and lower terminal portions upper and lower connecting means, respectively, for connecting it to the adjacent links, (f) a lower anchoring member comprising a slotted element, and (g) connecting means for connecting the lowermost links of each of the tapes to the anchoring member, the connecting means including a plurality of coil springs, one for each tape, with one end penetrating a slot and secured to the anchoring member and the other end secured to the lower link of the associated tape.

* * * * *